US012251619B2

(12) United States Patent
Feldman

(10) Patent No.: US 12,251,619 B2
(45) Date of Patent: Mar. 18, 2025

(54) RING FOR A FIGHTING SPORT

(71) Applicant: David Feldman, Broomall, PA (US)

(72) Inventor: David Feldman, Broomall, PA (US)

( * ) Notice: Subject to any disclaimer, the term of this patent is extended or adjusted under 35 U.S.C. 154(b) by 0 days.

(21) Appl. No.: 17/747,850

(22) Filed: May 18, 2022

(65) Prior Publication Data

US 2022/0274005 A1 Sep. 1, 2022

Related U.S. Application Data

(62) Division of application No. 16/980,632, filed on Sep. 14, 2020, now Pat. No. 11,351,440.

(51) Int. Cl.

| | |
|---|---|
| ***A63C 19/08*** | (2006.01) |
| ***A63B 71/00*** | (2006.01) |
| ***A63C 19/00*** | (2006.01) |
| ***A63C 19/06*** | (2006.01) |

(52) U.S. Cl.

CPC ..... *A63C 19/005* (2013.01); *A63B 71/0054* (2013.01); *A63C 19/065* (2013.01); *A63C 19/08* (2013.01); *A63B 2071/0063* (2013.01); *A63B 2210/50* (2013.01); *A63C 2019/085* (2013.01)

(58) Field of Classification Search

CPC ..... A63C 19/00; A63C 19/005; A63C 19/065; A63C 19/08

USPC ..... 472/88–90, 92–94, 117; 273/108

See application file for complete search history.

(56) References Cited

U.S. PATENT DOCUMENTS

| | | | | |
|---|---|---|---|---|
| 485,896 | A | 11/1892 | Sterry, Jr. | |
| 1,435,326 | A | 11/1922 | Mullin | |
| 1,753,328 | A | 4/1930 | Barnes | |
| 2,119,327 | A | 7/1936 | Gunnarson | |
| 2,243,943 | A | 9/1940 | Bunting | |
| 2,726,866 | A | 12/1955 | Nally | |
| 3,245,188 | A | 4/1966 | Evans | |
| 3,876,197 | A | 4/1975 | Jenson | |
| 6,340,334 | B1 | 1/2002 | Olsen et al. | |
| 8,109,835 | B2 | 2/2012 | Norris | |
| 8,876,616 | B2 * | 11/2014 | Antuna | A63C 19/005 256/26 |
| D793,496 | S | 8/2017 | Maurizot | |
| 2009/0020956 | A1 | 2/2009 | Maccall | |
| 2009/0131183 | A1 * | 5/2009 | Kennedy | A63C 19/062 273/108 |
| 2011/0012310 | A1 | 1/2011 | Anderton et al. | |
| 2011/0172019 | A1 | 7/2011 | Jeffrey | |
| 2013/0017895 | A1 | 1/2013 | Mechling et al. | |
| 2016/0279457 | A1 * | 9/2016 | Adams | A63B 5/11 |
| 2017/0134712 | A1 | 5/2017 | Remer | |
| 2018/0126251 | A1 | 5/2018 | Gurgel et al. | |
| 2019/0226222 | A1 * | 7/2019 | DePietro | E04B 5/14 |

FOREIGN PATENT DOCUMENTS

| | | |
|---|---|---|
| CN | 206454243 U | 9/2017 |
| RU | 168430 U1 | 2/2017 |

* cited by examiner

*Primary Examiner* — Kien T Nguyen

(74) *Attorney, Agent, or Firm* — Paul & Paul

(57) ABSTRACT

A ring for a fighting sport has a circular fighting area defined by a plurality of circular fence rings that are held up by posts. Shock absorbers connect the fence rings to the posts. Position markers are provided to indicate the starting positions of the participating fighters at certain points during the bout.

6 Claims, 6 Drawing Sheets

RING FOR A FIGHTING SPORT

CROSS-REFERENCE TO RELATED APPLICATIONS

This application is a division of U.S. patent application Ser. No. 16/980,632, filed Sep. 14, 2020, which is the United States national phase filing under 35 U.S.C. 371 of International Application No. PCT/US2019/022315 filed Mar. 14, 2019 which claims the priority of U.S. Provisional Application 62/643,160 filed Mar. 14, 2018, and U.S. Provisional Application 62/643,673 filed Mar. 15, 2018, all of which are incorporated herein in their entirety by reference.

BACKGROUND OF THE INVENTION

1. Field of the Invention

This invention relates to rings for fighting sports.

2. Brief Description of the Prior Art

Rings for fighting sports are known. For example, U.S. Patent 485,896 discloses a boxer's ring in which the ropes surrounding the ring are suspended from the upright supporting posts by elastic stays or springs. U.S. Pat. No. 1,435,326 discloses a prize ring in which the supporting posts are angled outward away from the center of the ring. U.S. Pat. No. 1,753,328 discloses a portable, collapsible fight ring including interlocking and coacting features such that it can be erected without driving spikes into the floor to maintain the ring parts in assembly. U.S. Pat. No. 2,119,327 discloses a demountable circular ring in which curved steel tubing covered with rubber is substituted for the conventional ropes, and the tubing is connected to supporting posts with springs. U.S. Pat. No. 2,243,943 discloses a portable boxing ring that can be assembled without using bolts or other permanent fastening means. U.S. Pat. No. 2,726,866 discloses a knock-down construction adaptable as a boxing ring which can be readily loaded, unloaded, set up and taken down by two individuals in a short period of time. U.S. Pat. No. 3,876,197 discloses a circular boxing ring in which three or four tubular ring members or rungs are connected to each other to form a circular ring. The ring members are constructed from pipe or rods and covered with a sponging padding, and are connected to supporting posts with hollow fixed members including compressed springs and acting as shock absorbers. U.S. Pat. No. 6,340,334 discloses a portable fight ring which permits users to quickly assemble a ring in their own backyards. U.S. Pat. No. 8,109,835 discloses a circular competition ring for martial arts. U.S. Patent Publication 2011/0012310 A1 discloses a mixed martial arts event and ring. U.S. Patent Publication 2011/0172019 A1 discloses a circular boxing ring floor. U.S. Patent Publication 2017/0134712 A1 discloses a circular martial arts cage equipped to provide three dimensional images of the participants for analyses. U.S. Patent Publication 2018/0126251 discloses a martial arts ring surrounded by a rigid and transparent material.

SUMMARY OF THE INVENTION

The present invention provides a ring for a fighting sport. The ring comprises a platform having a top surface that provides the floor of the ring for a fighting sport; and a plurality of fence rings, said plurality of fence rings being coaxially distributed along a central vertical axis such that each of said fence rings is provided at a corresponding predetermined height above said floor and each of said plurality of fence rings is approximately superimposed over the next lower one of said plurality of fence rings in top plan view, said plurality of fence rings defining a circular fighting area on said floor, and said circular fighting area having a center through which passes said central vertical axis.

Preferably, the ring for a fighting sport further includes a plurality of posts for supporting said fence rings above said floor of the ring for a fighting sport, the plurality of posts being evenly distributed along the perimeter of a circle concentric with said circular fighting area but having a diameter larger than the diameter of said circular fighting area; and a plurality of shock absorbers, each of said fence rings being connected to each of said posts by one of said plurality of shock absorbers.

In another aspect, the present invention provides a ring for a fighting sport having a platform having a top surface that provides the floor of the ring for a fighting sport; a circular fighting area demarcated on said top surface of said platform, the circular fighting area having a center; and at least two position markers that are rectangular in top plan view.

Preferably, the ring for a fighting sport includes position markers placed in parallel and a predetermined distance apart, symmetrically about the center of the circular fighting area to indicate the starting positions for fighters participating in the fighting sport, wherein said position markers have a height above the top surface of the platform, and wherein the position markers are removed when the fighting is initiated.

Preferably, the position markers are placed in parallel and a predetermined distance apart, symmetrically about the center of the circular fighting area to indicate the starting positions for fighters participating in the fighting sport.

Preferably, the position markers are movable between an extended and a retracted position, wherein the position markers have a top surface, wherein said position markers have a height above the top surface of the platform when in the extended position, and wherein the top surface of said position markers is even with said top surface of the platform when said position markers are in said retracted position.

DETAILED DESCRIPTION OF THE PREFERRED EMBODIMENTS

Figure 1:
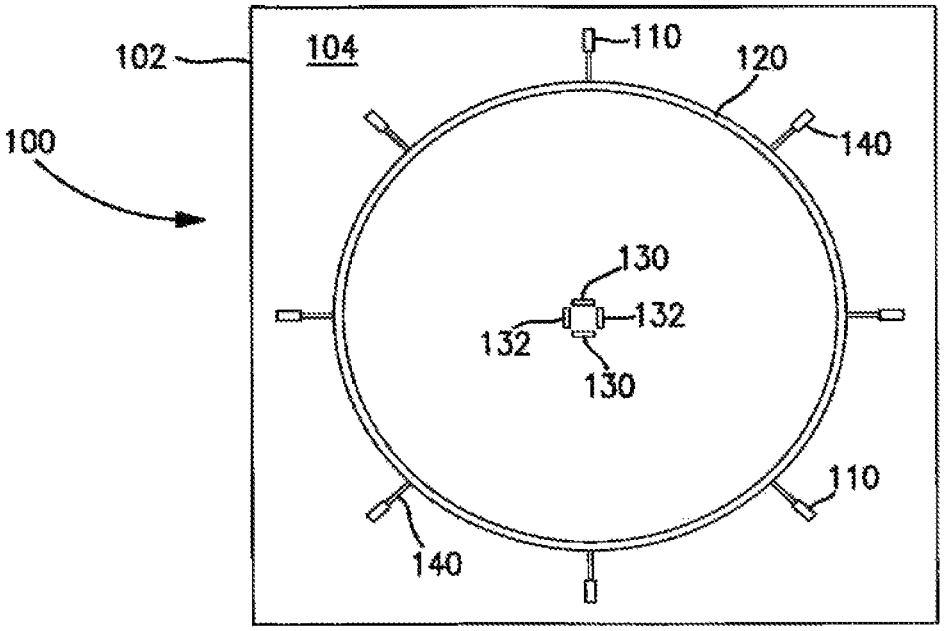
FIG. 1 is a top plan view of a ring for a fighting sport according to the present invention.
Figure 2:
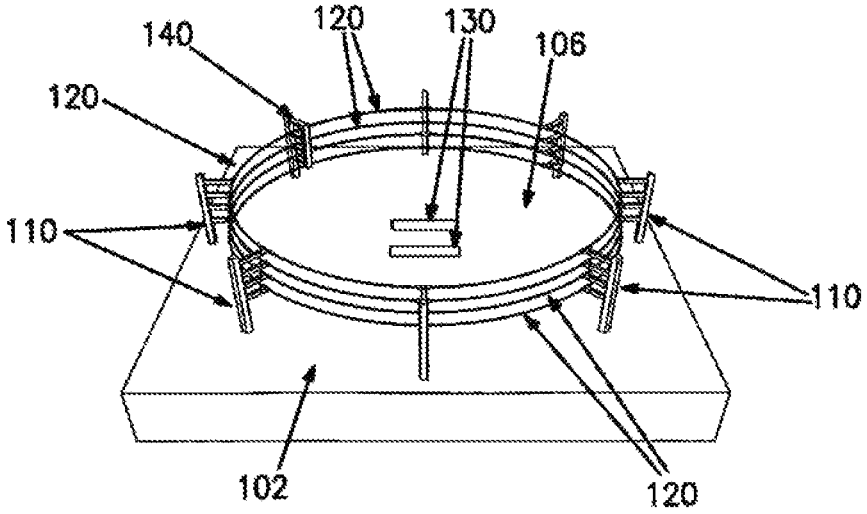
FIG. 2 is a perspective view of the ring of FIG. 1.
Figure 3:
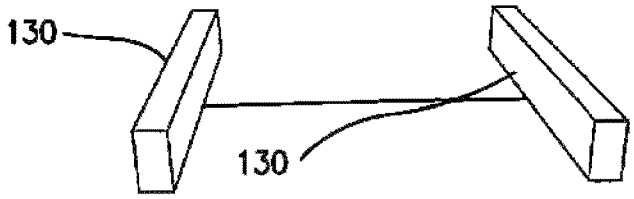
FIG. 3 is a fragmentary perspective view of a pair of raisable marker platforms shown above the surface of the platform of the ring of FIG. 1.
Figure 4:
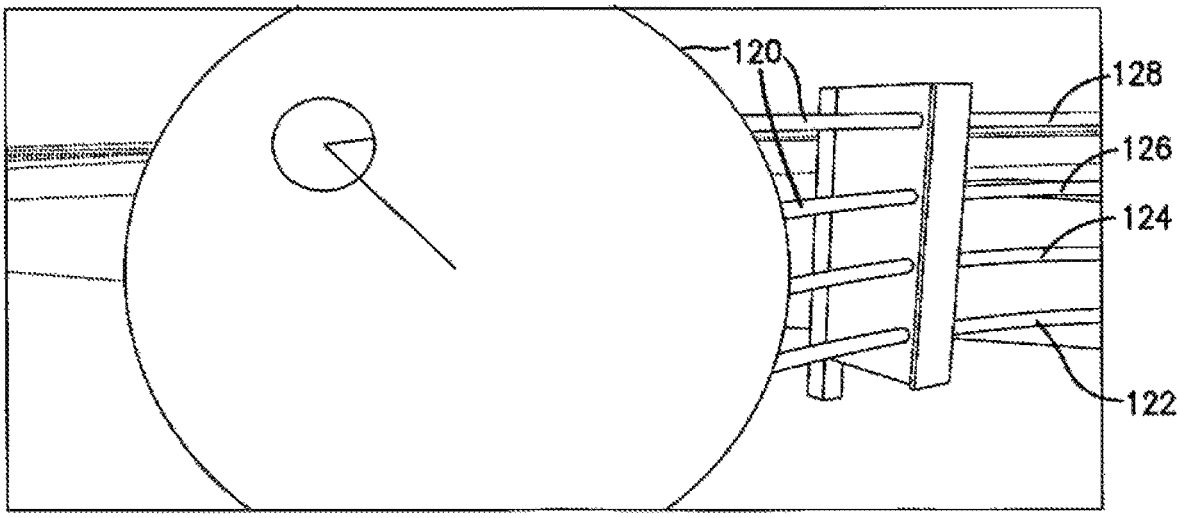
FIG. 4 is a fragmentary perspective view of a portion of the ring of FIG. 1 showing a section through one of the fence rings.

Referring now to the figures in which like reference numerals represent like elements in each of the several views, there is shown in FIG. 1, a plan view of a ring 100 for a fighting sport. The ring 100 includes a generally square platform 102 formed of a rigid material and covered with a shock absorbing mat 104 (best seen in the fragmentary views of FIGS. 6 and 7). In a presently preferred embodiment, the platform is about 28 foot square, and the upper surface of the platform is about 42 inches above the surface supporting the ring 100. The mat 104 provides cushioning and shock absorbency for safety in the event that any of the participants in the fighting event fall on the ring floor. There are no enclosures or barriers on the exterior (outside) of the square platform.

A circular ring or fighting area 106 is provided inside the square area defined by the platform top or the mat 104. The circular fighting area 106 is defined by and/or surrounded by a system of posts 110 and "ropes" 120, as will be described below. Optionally, the circular fighting area 106 may be demarcated by contrasting colors of the circular fighting area 106 and the area of the platform outside the circular fighting area, or by a line along the perimeter of the circular fighting area 106. The circular fighting area 106 is surfaced by the mat 104 and is thus cushioned. In a presently preferred embodiment, the circular fighting area 106 is about 22 feet in diameter, which gives the circular fighting area 106 a circumference of about 69 feet.

Located at the center of the circular fighting area 106, which may also sometimes be referred to herein as the circular boxing ring, at least at the outset of each fight or the first round, and optionally at the outset of one or more subsequent rounds, for example, the final round, there are provided two raised "Toe The Line" raisable marker platforms or bars 130, which the fighters shall stand on or put their feet directly behind. In a presently preferred embodiment, the "Toe The Line" bars 130 are to be painted black and marked where the fighters meet face-to-face during certain key portions of each fight. Non-limiting examples of such key portions of each fight include:

1) At the beginning of each fight;
2) At the beginning of each round; and
3) After each knockdown, if both fighters are capable of continuing the fight (i.e., if the fight does not end by TKO or KO).

Other than the outset of the First and Final Rounds, two "Toe The Line" decals 132, at the center of the ring near each other (one for each fighter) can be provided and may be used to replace the "Toe The Line" raisable marker platforms 130 used at the outset of Round One and the Final Round, after all knockdowns (where the fight resumes), and at the beginning of each round. Optionally, decals 132 or painted/printed bars may replace the raisable marker platforms 130 entirely. However, in a currently preferred embodiment, the "Toe The Line" raisable marker platforms 130 are used at the outset of Round One and the Final Round, while decals 132 or painted bars are used after all knockdowns (where the fight resumes), and at the beginning of each round.

The raisable marker platforms 130, decals 132, and painted bars are examples of position markers that can be used during a bout. Other examples of position markers are rectangular platforms that can be raised or lowered under the control of a judge or referee or other official (not shown). The control can be exercised from outside the ring or by the referee in the ring through a remote connection that can be wireless or through a wire (not shown). A wireless control would be preferred if the controlling official is in the ring during the bout. The raisable marker platforms 130 can be raised or lowered using any suitable mechanism. Examples of suitable mechanisms for raising and lowering the marker platforms include, without limitation, hydraulic jacks, scissor jacks or lift, screw jacks, and the like. These may be hydraulically or electromechanically powered and controlled through servo-control mechanisms. The tops of the raisable marker platforms 130 are preferably provided with the same cushioning material as the mat 104, and the upper surfaces of the raisable marker platforms 130 are preferably even with the top surface of the mat 104 when the marker platforms 130 are lowered. At least the top surfaces of the marker platforms may be of a contrasting color compared to the rest of the top surfaces of the circular fighting area (not shown).

Figure 6:
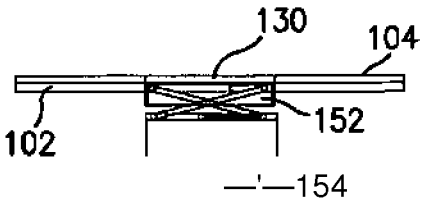
FIG. 6 is a side elevational view of a portion of the ring of FIG. 1 showing a raisable marker platform is a first of retracted position.
Figure 7:
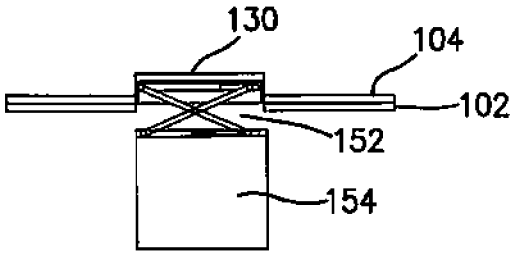
FIG. 7 is a side elevational view of the portion of the ring of FIG. 6 showing a raisable marker platform is a second or extended position.

Referring to FIGS. 6 and 7, the raisable position markers 130 are raised and lowered by the scissor jacks 152 that are driven by hydraulic actuators 154.

In a presently preferred embodiment, the raisable marker platforms 130 have dimensions of about three inches wide, about six inches high when raised above the mat 104, and about four feet long. In a presently preferred embodiment, at the outset of the fight and the final round, there will be two black raised "Toe The Line" platforms that are located in the center of the ring, three feet apart. For all other rounds and for knockdowns where the fight proceeds, there will be two "Toe The Line" black decals 132 which replace the platforms.

Figure 5:
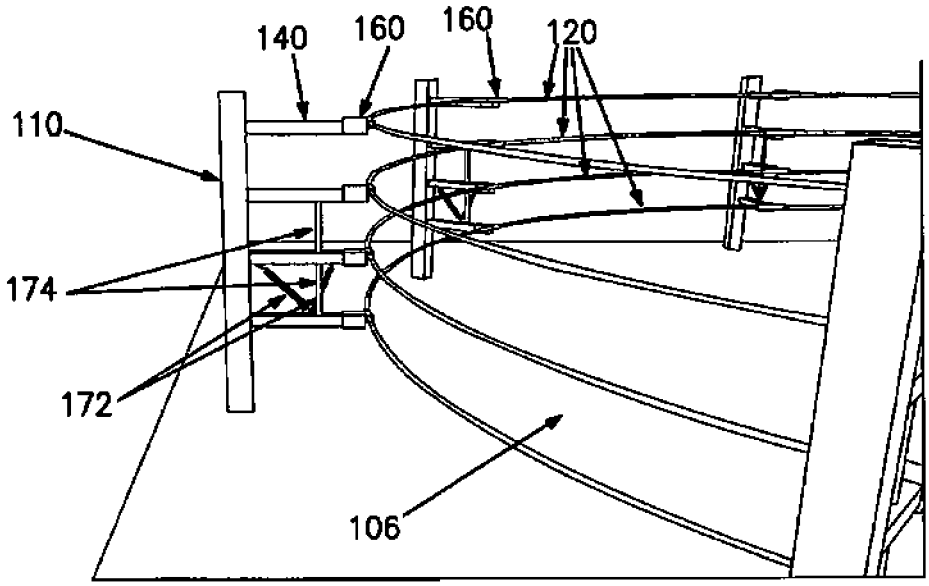
FIG. 5 is a fragmentary perspective view of the ring of FIG. 1 showing the supporting posts, post arms, and fence rings.
Figure 8:
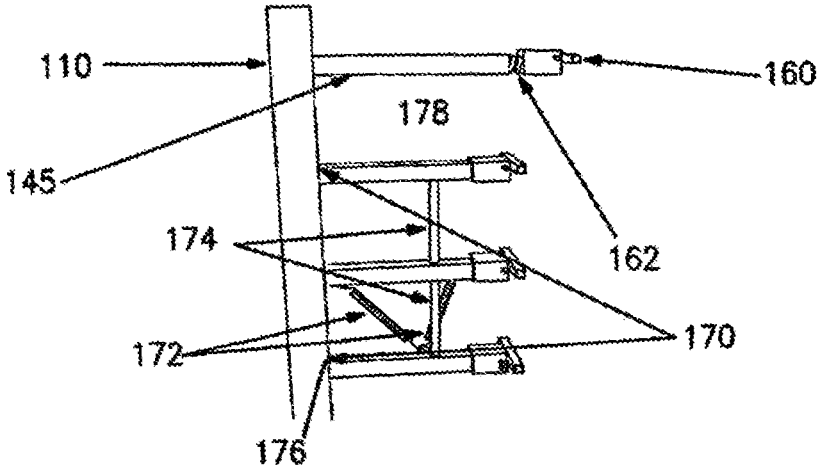
FIG. 8 is a fragmentary side elevational view of the ring of FIG. 5 showing a post, associated post arms, "'T'"-connectors for the fence rings, and springs.

In the presently preferred embodiment, there are eight black posts 110, located at an equal distance from each of their neighboring posts (approximately 8¾ feet apart). As best seen in FIGS. 5 and 8, each of the eight posts 110 are welded to four post arms 140, each of which connects to a post rope "T"-connector 160. The "ropes" or fence rings 120 and posts 110 provide enhanced safety through the use of springs 162 located inside of each post rope "T"-connector 160, which connects the post arm 140 to each "rope" 120, thus forming a shock absorber 164.

In a presently preferred embodiment, the post rope "T"-connector 160 is made of a two inch by two inch square hollow steel tube having a wall thickness of about one eighth of an inch, welded perpendicular to a one inch by one inch tube with a wall thickness of about one eighth of an inch. Each "rope" 120 is suspended by connecting to each post rope "T"-connector. The effect of these springs 162 is that they allow for some "give" (reduces the severity of the impact) when a fighter goes against the posts 110; that is, they provide a "shock absorber" effect.

The post arms 140 extend from each post 110 to a corresponding one of the "ropes" 120. In a presently preferred embodiment, the posts 110 are made of four inch by four inch square hollow steel tubing having a wall thickness of about one quarter of an inch. Four posts 110 are positioned symmetrically about the center of the circular fighting area 106 on diagonals of the outer square perimeter of the ring floor or platform 102, and four posts 110 are positioned symmetrically about the center of the circular fighting area 106 on midlines of the outer square perimeter of the ring floor or platform 102; each midline extending between a pair of opposing sides of the outer square perimeter of the ring floor perpendicular to the pair of opposing sides. In a presently preferred embodiment, the posts 110 rise about five feet above the ring floor, and extend down about three and one-half feet to the ground below the platform 102. The posts 110 are preferably positioned about two feet from the "ropes" 120 outside of the "ropes" 120 and of the circular fighting area 106.

In a presently preferred embodiment, four "ropes" or fence rings 120, namely, a first or lowest fence ring 122, a second fence ring 124 spaced above the lowest fence ring 122, a third fence ring 126 spaced above the second fence ring 124, and a fourth or upper fence ring 128 spaced above the third fence ring 126. The four fence rings 120 are attached to a corresponding post arm 140. Thus, the lowest or first fence ring 122 is connected to a first or lowest post arm 142 on each post 110; the second fence ring 124 is connected to a second post arm 144 spaced above the first post arm 142; the third fence ring 126 is connected to a third post arm 146 spaced above the second post arm 144; and the upper or fourth fence ring 128 is connected to an upper or fourth post arm 148 spaced above the third post arm 146. Preferably, the post arms 140, and hence the fence rings 120, are approximately evenly spaced.

As can be seen in FIG. 8, there is preferably provided, as an additional safety feature, that the lowest post arm 142 (closest to the platform or ring floor 102) be provided with a lower post arm hinge 176 that connects the post arm 142 to the post 110, such that the post arm 142 can pivot when urged downward. The lowest post arm 142 is also connected, at about the midpoint of the lowest post arm 142, to two springs 172 on the lowest post arm 142 that connect, at two different, spaced positions, to the second post arm 144. This arrangement allows the first or lowest fence ring 122, which is closest to the ring floor, to pivot downward when a fighter is knocked down and bumps into it. To prevent the lowest post arm 142 from bending in an upward direction, a "rope" spacer 174 is mounted in the second post arm 144 and extends down to, abuts against, but is not connected to, the upper surface of the lowest post arm 142.

To allow participants to enter the circular ring 100, the third post arm 146 is equipped with a hinge 178 that connects the post arm 146 to the post 110 which allows the post arm 146 to swing up. This allows the third fence ring 126 to be raised by a user and allow a participant the space to enter the ring 110. To prevent the third post arm 146 from bending in a downward direction, a "rope" spacer 174 is mounted in the second post arm 144 and extends upward, abuts against, but is not connected to, the lower surface of the third post arm 146. The hinges 170 thus can each be urged in opposite directions.

In a presently preferred embodiment, the "ropes" or fence rings 120 are formed from arcuate sections of steel tubing with an outside diameter of five-eighths of an inch which extend between and are mounted to the post arms 140 with the "T"-connectors 160. Preferably, the steel tubes are covered in foam padding 150. Preferably, a 16 gauge white, non-slip vinyl sleeve fits over the padding 150. Preferably, four fence rings or "ropes" 120 surround the circular fighting area 106. The lowest "rope" 122 is preferably located about 18 inches above the mat 104, the mat 104 covering the floor of the circular fighting area 106. The second lowest "rope" 124 is preferably located about 30 inches above the mat 104. The third lowest "rope" 126 is preferably located about 42 inches above the mat 104. The upper "rope" 128 is preferably located about 54 inches above the mat 104.

The padding 150 on the "ropes" 120 is preferably from about three-quarters of an inch to about two inches thick.

Padding 150 is also provided to completely encase the post arms 140 and their connections to the posts 110 and to the "ropes" or fence rings 120.

This padding 150 also covers the surface of posts 110 opposite the connections between the post arms 140 and the fence rings or "ropes" 120. This padding 150 is preferably about six feet high, about one foot wide measured perpendicularly to the longitudinal axis of the post arms, about four inches thick, and is made of dense foam.

Figure 9:
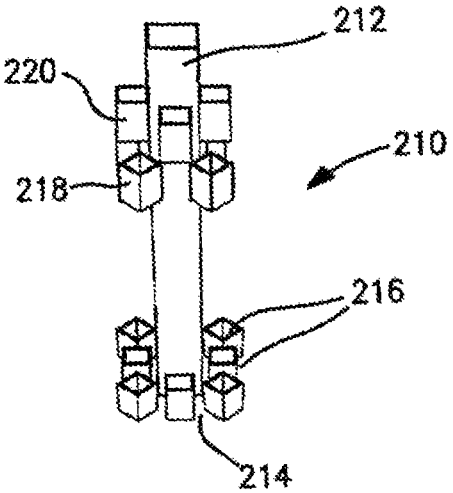
FIG. 9 is a perspective view of a central support post for the ring of FIG. 1.

The platform 102 is preferably supported by a modular set of support posts and girders or support system 200 such that the ring 100 can be quickly erected and disassembled. FIG. 9 is a perspective view of a central support post 210 for the ring of FIG. 1. The central support post 210 includes a four-sided upright member 212 preferably formed from as strong structural material such as steel welded to a base plate 214. Eight anchor pockets or base anchors 216 are welded to the base plate 214 and positioned to receive downwardly extending pins welded to the ends of girders 250 extending generally parallel to the platform 102. A second set of four middle anchor pockets 218 are welded near the upper end of the upright member 212 on corners of the sides of the upright member 212. A third set of four upper anchor pockets 220 are welded just above the second set on the sides of the upright member 212. The anchor members 216, 218, 220 each receive a corresponding pin welded to the end of a girder when the support system has been assembled.

Figure 10:
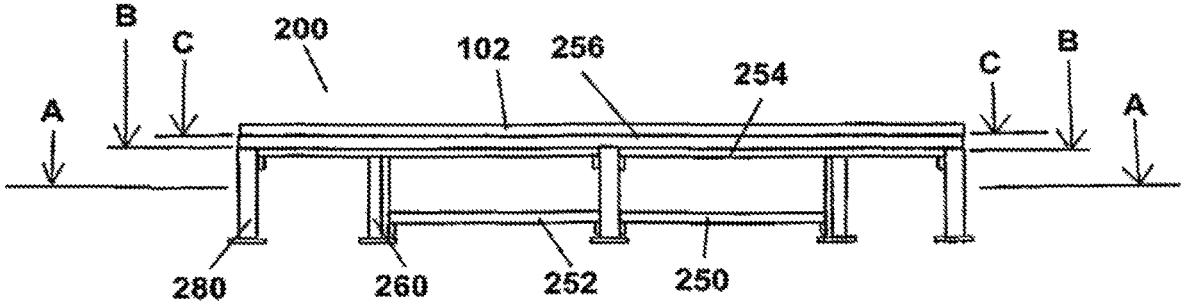
FIG. 10 is a front side elevational view of a modular support system for the platform of the ring of FIG. 1.
Figure 11:
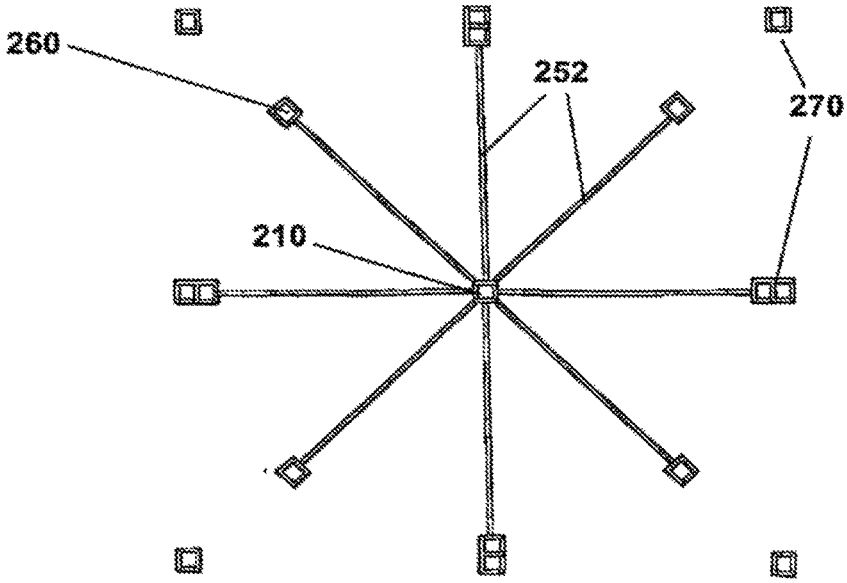
FIG. 11 is a top plan sectional view of the support system of FIG. 10 taken along the lines A-A of FIG. 10.

FIG. 10 is a front side elevational view of the modular support system 200 for the platform 102. The support system 200 includes a set of lower girders 252, a set of upper girders 254, as well as a set of floor girders 256 which are supported upon the upper girders 254. A set of four inner posts 260 are positioned along the diagonals of the square platform, which a set of eight outer posts 270 are positioned at the corners and the midsections of the edges of the square platform. FIG. 11 is a top plan sectional view of the support system of FIG. 10 taken along the lines A-A of FIG. 10, showing that the lower girders 252 extend only from the central support post 210.

Figure 13:
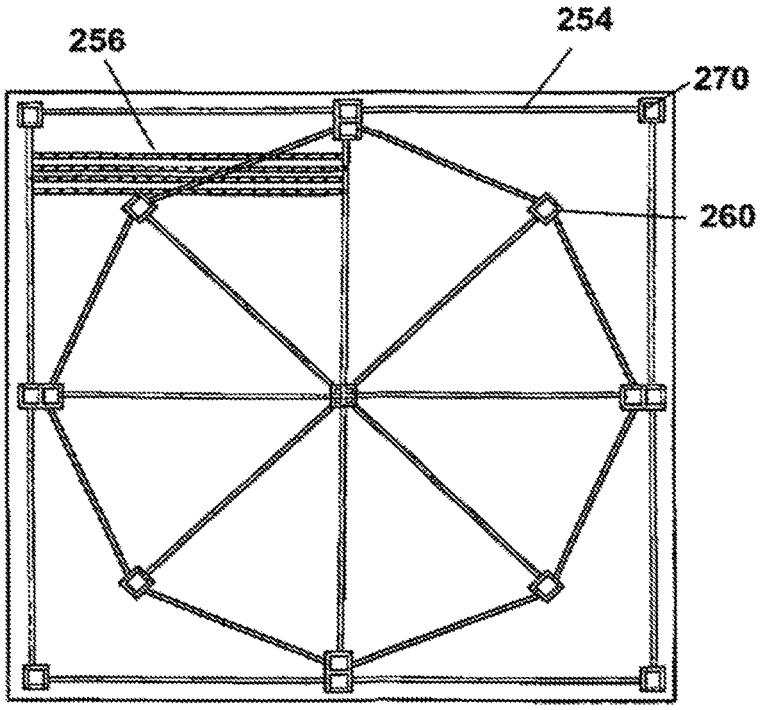
FIG. 13 is a top plan sectional view of the support system of FIG. 10 taken along the lines C-C of FIG. 10.
Figure 12:
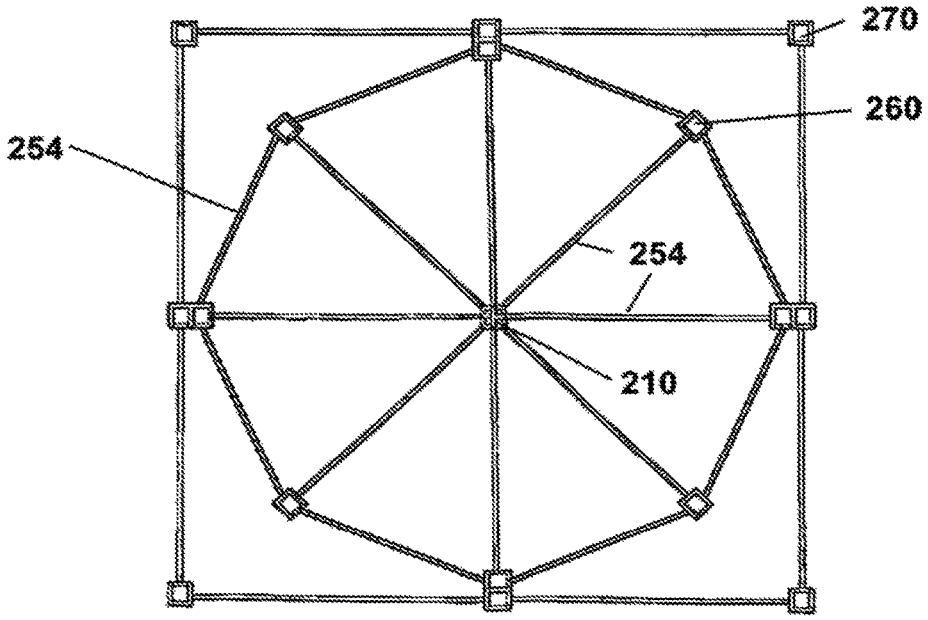
FIG. 12 is a top plan sectional view of the support system of FIG. 10 taken along the lines B-B of FIG. 10.

FIG. 12 is a top plan sectional view of the support system of FIG. 10 taken along the lines B-B of FIG. 10, showing that the upper girders 254 extend between the central support post 210 and both the inner posts and the subset 280 of outer posts 270 that are positioned at the midpoints of the edges of the platform 102, while additional upper girders 254 extend between the outer posts 270 at the corners of the square platform 102 as well as between the inner posts 260 and the outer posts 270 at the midpoints of the edges of the platform 102. FIG. 13 is a top plan sectional view of the support system of FIG. 10 taken along the lines C-C of FIG. 10, showing a few of the floor girders 256 extending between the upper girders 254 having anchor pockets welded thereto, and secured with corresponding pins welded to the floor girders 256. The floor girders 256 can be covered with a suitable stable flooring material. The posts 110 which extend above the platform 102 also extend through the platform 102 and are mounted in the upper ends of the inner posts 260 and the subset 280 of outer posts positioned at the midpoints of the edges of the platform 102.

Various modifications can be made in the details of the various embodiments of the articles of the present invention, all within the scope and spirit of the invention and defined by the appended claims.

The invention claimed is:

1. A ring for a fighting sport comprising:

a platform having a top surface that provides the floor of the ring for a fighting sport and supported by a support system comprising a central support post and a set of lower girders that extend only from the central support post and are generally parallel to the platform;

a plurality of fence rings, said plurality of fence rings being coaxially distributed along a central vertical axis such that each of said fence rings is provided at a corresponding predetermined height above said floor and each of said plurality of fence rings is approximately superimposed over the next lower one of said plurality of fence rings in top plan view, said plurality of fence rings defining a circular fighting area on said floor, and said circular fighting area having a center through which passes said central vertical axis;

a plurality of posts for supporting said fence rings above said floor of the ring for a fighting sport are extending down below the platform, said plurality of posts being evenly distributed along the perimeter of a circle concentric with said circular fighting area but having a diameter larger than the diameter of said circular fighting area; and a plurality of shock absorbers, each of said fence rings being connected to each of said posts by one of said plurality of shock absorbers;

wherein at least one fence ring is mounted such that the at least one fence ring can be urged against a spring return force in one of either an upward or downward direction.

2. A ring for a fighting sport according to claim 1 wherein the plurality of fence rings includes a lowest fence ring mounted for deflection in a downward direction.

3. A ring for a fighting sport according to claim 1 wherein the plurality of fence rings includes a middle fence ring mounted for deflection in an upward direction.

4. A ring for a fighting sport comprising:

a platform having a top surface that provides the floor of the ring for a fighting sport and supported by a support system comprising a central support post and a set of lower girders that extend only from the central support post and are generally parallel to the platform;

a circular fighting area demarcated on said top surface of said platform, said circular fighting area having a center; and at least two position markers that are rectangular in top plan view.

5. The ring for a fighting sport according to claim 4, wherein said position markers can be placed in parallel and a predetermined distance apart, symmetrically about the center of the circular fighting area to indicate the starting positions for fighters participating in the fighting sport, wherein said position markers have a height above the top surface of the platform, and wherein the position markers are removed when the fighting is initiated.

6. The ring for a fighting sport according to claim 4, wherein said position markers are placed in parallel and a predetermined distance apart, symmetrically about the center of the circular fighting area to indicate the starting positions for fighters participating in the fighting sport.

* * * * *